US008820588B2

(12) United States Patent
Ghavami-Nasr et al.

(10) Patent No.: US 8,820,588 B2
(45) **Date of Patent: *Sep. 2, 2014**

(54) LIQUID DISPENSING APPARATUS

(75) Inventors: Ghasem Ghavami-Nasr, Salford (GB); Andrew John Yule, Salford (GB); Martin Laurence Burby, Salford (GB)

(73) Assignee: The University of Salford, Salford (GB)

( * ) Notice: Subject to any disclaimer, the term of this patent is extended or adjusted under 35 U.S.C. 154(b) by 154 days.

This patent is subject to a terminal disclaimer.

(21) Appl. No.: 12/901,043

(22) Filed: Oct. 8, 2010

(65) Prior Publication Data

US 2011/0108582 A1 May 12, 2011

Related U.S. Application Data

(60) Provisional application No. 61/260,052, filed on Nov. 11, 2009.

(30) Foreign Application Priority Data

Oct. 9, 2009 (GB) ..... 0917731.2

(51) Int. Cl.
*B65D 83/00* (2006.01)
*B65D 83/54* (2006.01)
*B65D 83/42* (2006.01)

(52) U.S. Cl.
CPC ..... *B65D 83/54* (2013.01); *B65D 83/425* (2013.01)
USPC ..... 222/402.2; 222/335; 222/402.1; 222/402.24; 222/328

(58) Field of Classification Search
CPC ..... B65D 83/54; B65D 83/425
USPC ..... 222/402.2, 335, 402.1; 137/627.5
See application file for complete search history.

(56) References Cited

U.S. PATENT DOCUMENTS

| | | | | |
|---|---|---|---|---|
| 3,018,928 | A * | 1/1962 | Meshberg | 222/335 |
| 3,169,677 | A * | 2/1965 | Focht | 222/402.2 |
| 3,394,851 | A | 7/1968 | Gorman | |
| 4,953,759 | A | 9/1990 | Schmidt | |
| 5,037,013 | A | 8/1991 | Howlett | |

FOREIGN PATENT DOCUMENTS

| | | | |
|---|---|---|---|
| JP | 2002-263531 | A | 9/2002 |
| WO | WO-95/11841 | A1 | 5/1995 |
| WO | WO-2004/041340 | A2 | 5/2004 |
| WO | WO-2005/018690 | A1 | 3/2005 |
| WO | WO-2007/045826 | A1 | 4/2007 |

* cited by examiner

*Primary Examiner* — Paul R Durand
*Assistant Examiner* — Jeremy W Carroll
(74) *Attorney, Agent, or Firm* — Tarolli, Sundheim, Covell & Tummino LLP

(57) ABSTRACT

A discharge assembly apparatus for discharging a metered volume of a liquid when used in combination with a liquid-containing, pressurized or pressurizable container includes an actuator assembly incorporating a valve stem having a discharge conduit arrangement with an inlet and an outlet, a metering chamber formed within the valve stem and incorporating a liquid discharge element, an inlet/outlet arrangement, and a housing wherein the valve stem and the inner surface of the housing define a fluid transfer passageway therebetween, the discharge conduit arrangement of the valve stem providing communication between the outlet of the metering chamber and the outlet of the valve stem via the fluid transfer passageway.

18 Claims, 6 Drawing Sheets

LIQUID DISPENSING APPARATUS

RELATED APPLICATIONS

This application claims priority from British Patent Application No. GB 0917731.2, filed Oct. 9, 2009 and U.S. Provisional Patent Application No. 61/260,052, filed Nov. 11, 2009, the subject matter of which is incorporated herein by reference.

FIELD OF INVENTION

The present invention relates to liquid dispensing apparatus for discharging a metered volume of a liquid. The invention relates more particularly (but not necessarily exclusively) to such an apparatus in the form of an aerosol dispensing apparatus.

BACKGROUND TO INVENTION

Two broad approaches exist to the self-propelled delivery of liquid from within an aerosol, being: (i) propulsion by means of a gas dissolved under pressure into solution with the liquid, and; (ii) the provision of substantially insoluble compressed gas within the aerosol container. Aerosol apparatus using a dissolved gas propellant (e.g. liquid natural gas, such as butane) rely upon flash-vaporisation of the dissolved gas out of the solution as a result of the pressure drop that occurs upon dispersal from the pressurised aerosol container into the atmosphere. Alternatively propulsion may be provided by an insoluble compressed gas (e.g. nitrogen, carbon dioxide or air) that is used to eject the liquid from the body of the aerosol container.

Many medical, air-freshener, insecticide and disinfectant aerosol applications require the delivery of volume metered doses from an aerosol container, and metered aerosol valves have been disclosed with respect to both methods of propulsion.

In the case of dissolved gas propellant, metered quantities of the propellant-liquid solution can be received into a metering chamber from the body of the aerosol container during a charging stage, before then being released to the atmosphere during a discharging stage, with the vaporisation of the dissolved gas (know as "flash vaporisation") driving the metered dose out of the metering chamber and into the atmosphere. The dissolved propellant used in such aerosol apparatus is typically butane, and the release of butane into the atmosphere has detrimental environmental and cost implications, as well as creating a fire safety risk. The avoidance of having to use such volatile propellants would be of significant environmental relevance.

Due to the relatively incompressible nature of the delivery liquid, a metered dose of delivery liquid will not automatically self-eject from a metering chamber. Accordingly several approaches have been used to drive the necessary ejection.

In one approach aerosol valves have been designed that bleed-off a quantity of compressed gas from the aerosol container into the metering chamber, which can then drive the accompanying liquid out of the chamber during discharge. Such a device is described in U.S. Pat. No. 3,394,851. However, such devices deplete the gas pressure within the aerosol container, thus requiring a high gas to liquid ratio with implications for manufacturing costs.

An alternative approach has used an elastomeric membrane as part of the metering chamber, which is distended during charging of a metering chamber, and which then collapses back into the chamber during the discharge stage driving the liquid contents from the metering chamber. A further related approach is known that uses a resilient bellows. Such devices are described in U.S. Pat. No. 4,953,759, U.S. Pat. No. 5,037,013 and WO9511841. Metering valves that use such resilient walls are liable to suffer from performance variations due to material variations of the resilient walls, associated implications for manufacturing yield, as well as vulnerability to reduced performance over lifetime due to deterioration of the resilient wall material.

According to a first aspect of the present invention there is provided a discharge assembly apparatus for discharging a metered volume of a liquid when used in combination with a liquid-containing, pressurised or pressurisable container, wherein the discharge assembly apparatus has:

(a) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus;

(b) a metering chamber formed within the valve stem and incorporating (i) a liquid discharge element which is moveable by fluid pressure from the container from a liquid primed position to a liquid discharged position to effect discharge of said metered volume of liquid and is moveable by a returning force from its liquid discharged position to its liquid primed position; and, (ii) an inlet/outlet arrangement for introduction of liquid from the container into the metering chamber and for discharge of liquid from the metering chamber; and (c) a housing wherein:

(i) the valve stem and the inner surface of the housing are arranged such that a fluid transfer passageway is defined therebetween, and (ii) the discharge conduit arrangement of the valve stem provides in the second limit position thereof communication between the outlet of the metering chamber and the outlet of the valve stem via said fluid transfer passageway.

According to a second aspect of the present invention there is provided a liquid dispensing apparatus with a discharge assembly for discharging a metered volume of a liquid held in a pressurised container of the apparatus, wherein the apparatus has:

(a) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus;

(b) a metering chamber formed within the valve stem and incorporating a liquid discharge element which is moveable by fluid pressure from the container from a liquid primed position to a liquid discharged position to effect discharge of said metered volume of liquid and is moveable by a returning force from its liquid discharged position to its liquid primed position;

(c) the discharge assembly comprising a housing wherein:

(i) the valve stem and the inner surface of the housing are arranged such that a fluid transfer passageway is defined therebetween, and (ii) the discharge conduit arrangement of the valve stem provides in the second limit position thereof communication between the outlet of the metering chamber and the outlet of the valve stem via said fluid transfer passageway.

According to a third aspect of the present invention there is provided a liquid dispensing apparatus with a discharge assembly for discharging a metered volume of a liquid held in a pressurised or pressurisable container of the apparatus wherein the apparatus has a metering chamber incorporating a liquid discharge element which is moveable by fluid pressure from the container from a liquid primed position to a liquid discharged position to effect discharge of said metered volume of liquid and is moveable by a returning force from its liquid discharged position to its liquid primed position;

wherein the liquid discharge element has a first side exposed to said metering chamber and an opposite second side exposed to fluid pressure from the container, the metering chamber is provided on the first side of the liquid discharge element with an inlet/outlet arrangement for introduction of liquid from the container into the metering chamber and for discharge of liquid from the metering chamber;

the liquid dispensing apparatus further comprising:

(a) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus, and (b) a valving arrangement such that when the valve stem is in its first limit position liquid may flow into the metering chamber from the pressurised container through the inlet/outlet arrangement and may not flow out of the metering chamber through the inlet/outlet arrangement and vice versa when the valve stem is at its second limit position;

wherein the metering chamber is formed within the valve stem.

The following description and all embodiments apply to all aspects of the present invention.

In accordance with the invention therefore a metered volume of a liquid is dispensed from the apparatus by means of a liquid discharge element which is moved along a metering chamber (to effect the discharge) by the pressure within the container. Advantageously, the present invention provides compressed gas propelled liquid dispensing apparatus that delivers uniform metered volumes of liquid propellant over lifetime, is inexpensive to manufacture, is manufacturable within narrow performance tolerances with high manufacturing yield, and has componentry resistant to the effects of ageing over product lifetime. Further, the present invention produces a high quality liquid aerosol without requiring a gas bleed from the aerosol container, thereby substantially maintaining aerosol spray performance throughout operational lifetime.

The apparatus in accordance with the invention is preferably in the form of an aerosol spray device.

The liquid discharge element employed in the liquid dispensing apparatus of the invention is preferably rigid to ensure that a known volume of liquid is dispensed without possible fluctuation in volumes as between successive discharges due to flexibility of the liquid discharge element.

In preferred constructions of apparatus in accordance with the invention, the apparatus is configured such that movement of the liquid discharge element (which may be in the form of a piston or a ball) from its liquid primed position in the metering chamber to its liquid discharged position is effected against the returning force. In other words, the returning force is applied during discharge of the apparatus and not only during recharging thereof. Conveniently the returning force is provided by virtue of the liquid discharge element being negatively buoyant in the liquid to be dispensed so that it has a tendency to "sink" within the metering chamber. The liquid discharge element may, for example, be of a metal such as stainless steel. Alternatively it may be of a synthetic polymeric material which is appropriately weighted (e.g. by means of metal inserts or by the incorporation therein of a densifying agent). Alternatively or additionally the returning force may be provided by a spring.

Preferred constructions of apparatus in accordance with the invention will be such that the liquid discharge element has a first side exposed to the metering chamber and an opposite second side exposed to fluid pressure from the container. In such an arrangement, the metering chamber will be provided on the first side of the liquid discharge element with an inlet/outlet arrangement for introduction of liquid from the container into the metering chamber and for discharge of liquid from the metering chamber. In some embodiments of the invention, the inlet and the outlet may be separate of each other. However in other embodiments of the invention a single port may serve as both an inlet and an outlet.

Generally apparatus in accordance with the invention will incorporate an actuator assembly incorporating a valve stem which is adapted for movement from a first limit position to a second limit position to effect discharge of the metered volume of liquid. In preferred embodiments of the invention, this movement (from the first to second position) will be against biasing means (e.g. a coil spring). The actuator assembly incorporates a valve stem. The actuator assembly may further incorporate an actuator cap.

In preferred embodiments of the invention, the valve stem has a discharge conduit arrangement with an inlet through which liquid is introduced into the discharge conduit arrangement and an outlet from which liquid is discharged from the apparatus. Such an embodiment also incorporates a valving arrangement which is such that wherein the valve stem is in its first limit position liquid may flow into the metering chamber from the pressurised container through the inlet/outlet arrangement to effect charging of the metering chamber and may not flow out of the metering chamber through the inlet/outlet arrangement. Conversely when the valve stem is in its second limit position, liquid may flow out of the metering chamber to the discharge conduit through the inlet/outlet arrangement to effect discharging of the metering chamber and may not flow into the metering chamber through the inlet/outlet arrangement.

The metering chamber is preferably provided within the valve stem with the liquid discharge element being moveable along an interior surface of the metering chamber. In such an embodiment, the liquid discharge element may be in the form of a piston which is preferably spherical or cylindrical. If the apparatus is to be used for metering accurate volumes (e.g. for medical purposes) then the liquid discharge element may be sealed against the valve stem and/or against the inner wall of the metering chamber. Preferably, the clearance between the liquid discharge element and the metering chamber is sufficient to create a seal between the liquid discharge element and the metering chamber, but not too small that the travel of the liquid discharge element between the first and second limit position is significantly impeded.

A particular advantage of a sphere being the liquid discharge element as opposed to a cylindrical piston is that a sufficient seal is created between the liquid discharge element and the metering chamber, but friction between the wall of the metering chamber and the sphere is minimised, thus allowing the sphere to travel more freely that a cylindrical piston for example. Also, the manufacturing tolerances for a cylindrical piston are higher than a sphere because the sphere can roll and rotate more freely than the former.

The outlet of the metering chamber may extend upwards from a lower end against which an upper surface of the piston is sealable. The upper surface of the piston may be provided with a seal for effecting the sealing. Advantageously, such sealing may provide a very reliable closure of liquid flow through the outlet of the metering chamber.

At least one pressure equalising channel may be provided in the upper portion of the exterior surface of the metering chamber to allow for equalisation of the pressure in the discharge conduit arrangement of the valve stem and that in the container when the valve stem is in the first limit position.

The valve stem may be rotatable about its axis between first and second rotary positions and wherein the apparatus is such that axial movement of the valve stem beyond its second limit position is prevented in the first rotary position of the valve stem but allowed in the second rotary position thereof to provide for filling and/or re-filling of the apparatus. Advantageously the requirement of such rotation of the axis to enable filling and/or re-filling of the apparatus prevents accidental depression of the valve stem into the filling position by the user during normal use.

The lower end of the valve stem may be provided with a slotted nose and the lower surface of the housing is provided with a fin arrangement and wherein, with the valve stem in its first rotary position, said nose abuts against the fin arrangement to provide for the second limit position of the applicator and in the rotary position of the valve stem the slotted nose locates over the fins to provide for movement of the valve stem beyond its second limit position.

Locating the metering chamber within the valve stem has the advantage of simplifying construction as compared to the case where a metering chamber is provided around the valve stem. Advantageously such a metering chamber may be particularly suitable for providing an apparatus with a metering chamber having a small metered volume. Further, such an apparatus may be particularly simple to manufacture as it does not require the provision of a partition wall and corresponding annular space around an annular metering chamber.

The valve stem may be biased from the second limit position to the first limit position. Such biasing may be effected by a spring.

The invention will be further described by way of example only with reference to the accompanying drawings, in which.

Figure 1:
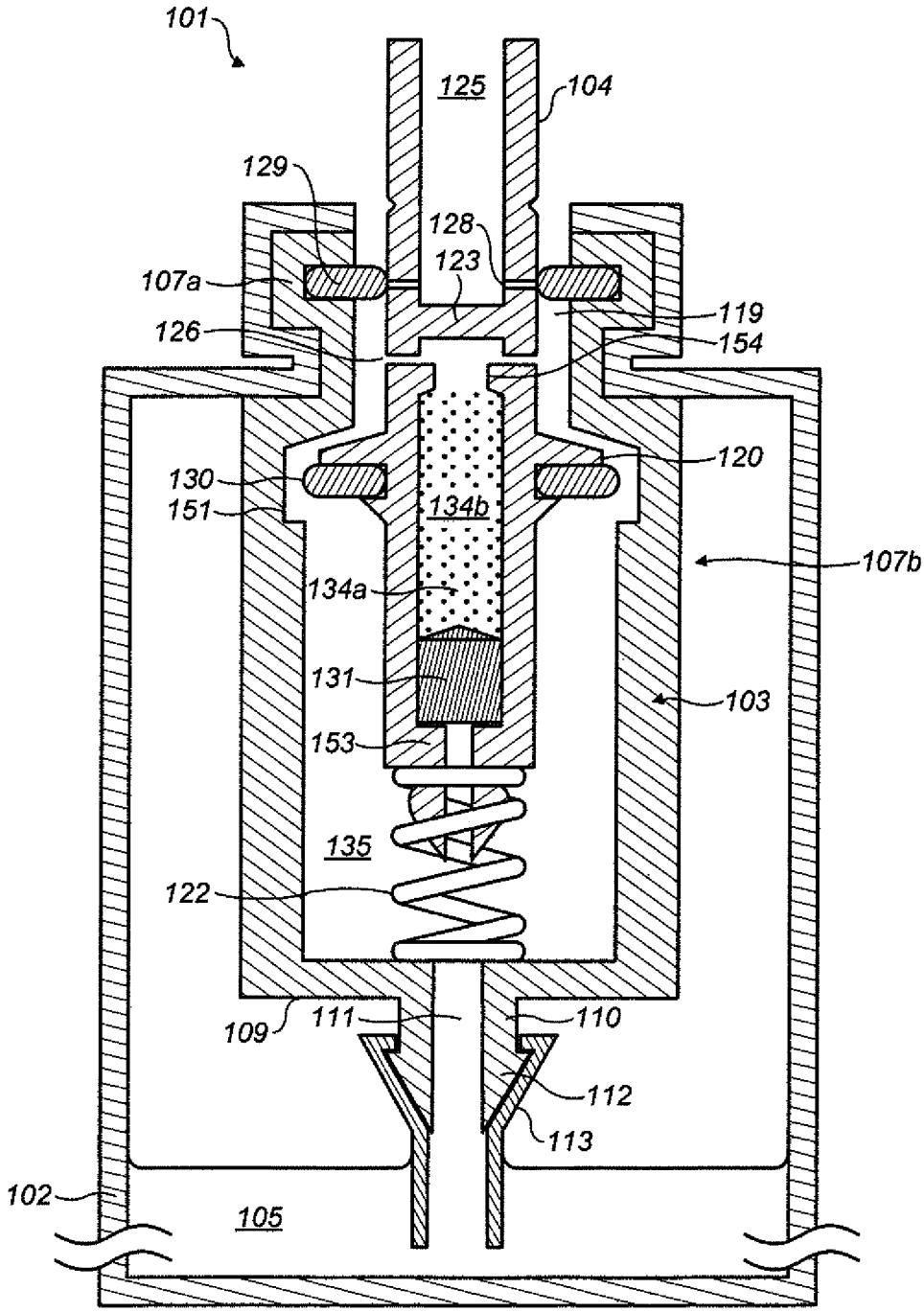
FIG. 1 is an axial section of an embodiment of liquid dispensing apparatus in accordance with the invention.

In the following description, references to "upper" and "lower" are to the embodiments of apparatus as illustrated in the drawings which are represented in their normal operational positions. In the following description, the "rest" condition is that in which the apparatus is primed and ready to emit a metered volume, with the valve stem in the uppermost position and the piston in the lower limit position.

In the following description, references to the valve stem being in the uppermost and lowermost positions correspond respectively with references to the valve stem being in first and second limit positions. References to the valve stem being in the depressed position correspond with references to the valve stem being in the lowermost position. References to piston correspond with references to liquid discharge element. References to the lower and upper limit positions correspond respectively with references to liquid primed and liquid discharged positions.

FIG. 1 illustrates a further embodiment of dispensing apparatus (in its "rest" condition) in accordance with the invention. The dispensing apparatus 101 comprises a container 102 (which in use is preferably pressurised) at the top of which is mounted a metering valve assembly 103 having a valve stem 104. The metered volume 134*b* and the piston 131 for dispensing the metered volume of liquid is provided internally of the valve stem 104.

In more detail, the metering valve assembly 103 comprises a housing formed in upper and lower sections 107*a* and 107*b* respectively, the former being of lesser cross-sectional size than the latter. Valve stem 104 is of a lesser diameter than the internal diameter of upper housing section 107*a* so an upper annular space 119 is defined between the outer surface of valve stem 104 and the inner surface of upper housing 107*a*. Lower wall 109 of housing section 107*b* is provided with a depending spigot 110 defining an inlet 111 for housing section 107*b* and having an enlarged lower end 112 on which is located the upper end of a dip tube 113 that extends to the lower region 105 of the container 102.

An annular groove 151 is formed in the interior surface of the lower housing section 107*b* at the upper level thereof.

Valve stem 104 is generally tubular along its length but is sub-divided by a partition wall 123 into an upper (open-topped) chamber 125 and a lower chamber 134*a*. The upper chamber 125 is part of the discharge conduit arrangement of valve stem 104.

Lower region of upper chamber 125 is provided with apertures 128 extending radially through the wall of valve stem 104 whereas apertures 126 are provided at the upper end of chamber 134*a*.

Provided within lower chamber 134*a* is a piston 131 which is negatively buoyant relative to liquid held within the container 102 for discharge by the device. Piston 131 is capable of travel between a lower limit position, limited by an annular rib 153 provided at a lower region of the lower chamber 134*a*, and an annular flange 154 provided at the upper region thereof. Accordingly, the lower chamber 134*a* provides a metering chamber within which the piston 131 moves during operation, sweeping out a metered volume 134*b*.

Upper and lower seals 129 and 130, are provided as shown. Seal 130 is mounted in a flange 120 provided around valve stem 104 and (in the "rest" condition illustrated in FIG. 9) locates at the level of the annular groove 151 in the inner wall of lower housing 107*a*. In this "rest" condition, seal 129 closes the aperture 128. The outer cross-sectional size of seal 130 is such that when valve stem 104 is depressed the seal 104 engages against the inner wall of the lower housing section 107*b* just below the level of annular groove 151 such that fluid is substantially prevented from flowing past the lower seal 130. However, in the "rest" condition, the lower seal 130 is located at the level of the annular groove 151 such the upper annular space 119 and the interior volume 135 are in continuous fluid connection, enabling fluid to flow past the lower seal as piston 131 returns back to the lower limit position, its rest position against annular rib 153.

A spring 122 provided as shown serves to bias valve stem 104 upwardly to its first limit position at which annular rib 120 abuts against the under surface of the upper wall of housing section 107*a*.

As depicted, the upper surface of the piston 131 is generally conical and is ideally made from soft polymer or rubber to ensure good seal against flange 154

Operation of the illustrated device is as follows.

In the "rest" condition illustrated in FIG. 1, the piston 131 is at its lower limit position and the metering valve assembly 103 is filled with liquid up to the level of seal 129. Once the valve stem 104 is depressed, the apertures 128 move away from the upper seal 129 so as to open to fluid flow, and the lower seal 130 moves down to engage against the inner wall of the lower housing section 107*b*. Thus liquid flow through apertures 128 occurs. The piston 131 is now forced upwardly by liquid pressure so that it moves from its lower limit position to its upper limit position and, in doing so, causes the metered volume of liquid 134*b* to be dispensed. Once the valve stem is released and it returns to its uppermost position under the action of spring 122, the apertures 128 again become closed to liquid flow but liquid is now able to flow past the seal 130 and enter the lower chamber 134*a* above the level of the piston 131 which now moves downwardly to its lower limit position so that the metered volume 134*b* is recharged.

The embodiment of FIG. 1 is particularly suitable for delivering small volume pulses as generally used in automatic air-freshener sprays, typically less than 150 $mm^3$.

Figure 2A:
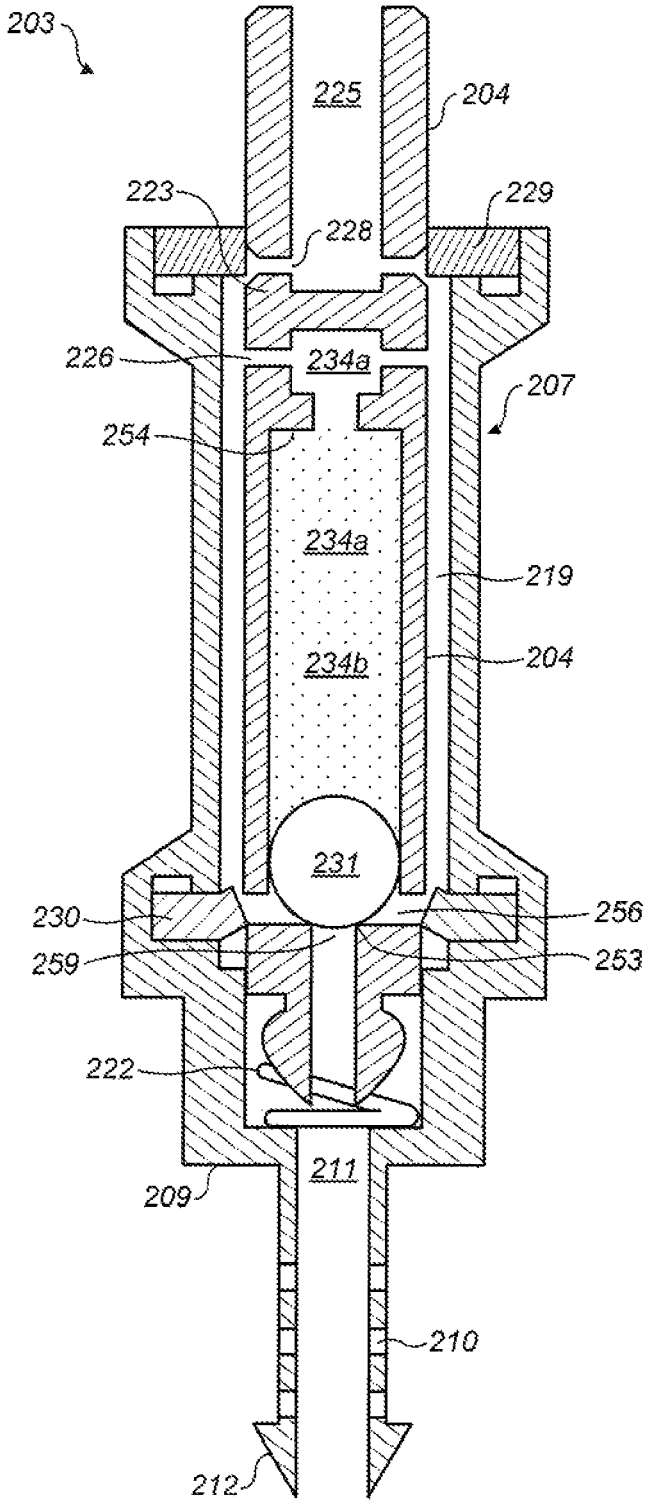
FIGS. 2A and 2B illustrate axial-section views of liquid dispensing apparatus in accordance with an further embodiment of the invention in successive stages of operation.

FIG. 2A illustrates a further embodiment of dispensing apparatus (in its "rest" condition) in accordance with the invention. For simplicity, the metering valve assembly 203 is shown without a corresponding container. The metered volume 234*b* and piston 231 for dispensing the metered volume of liquid is provided internally of the valve stem 204.

The metering valve assembly 203 comprises a housing 207 that encircles the valve stem 204, with an annular space 219 being defined between the outer surface of the valve stem and the inner surface of the housing. Lower wall 209 is provided with a depending spigot 210 defining an inlet 211 for housing section 207*b* and having an enlarged lower end 212 on which is located the upper end of a dip tube (not shown) that extends to the lower region of the container (not shown) into which the metering valve assembly 203 is connected.

Valve stem 204 is generally tubular along its length but is subdivided by partition wall 223 into an upper (open-topped) chamber 225 and a lower chamber 234*a*. The upper chamber 225 is part of the discharge conduit arrangement of valve stem 204.

Valve stem 204 is provided with three sets of apertures extending radially outwardly from the internal chambers 225 and 234*a*. More particularly, lower region of lower chamber 234*a* is provided with first apertures 256, upper region of the lower chamber 234*a* is provided with second apertures 226, and lower region of upper chamber 225 is provided with third apertures 228.

Provided within lower chamber 234*a* is a spherical piston 231, which is negatively buoyant relative to liquid held within the container for discharge by the device. Piston 231 is capable of travel between a lower limit position, limited by seat 253 provided at a lower region of the lower chamber 234*a*, and annular flange 254 provided within an upper region of the lower chamber. Accordingly, the lower chamber 234*a* provides a metering chamber within which the piston 231 moves during operation, sweeping out a metered volume 234*b*.

A spring 222 provided as shown serves to bias valve stem 204 upwardly to its first limit position.

Upper and lower seals 229 and 230 are provided within the housing 207 and form a sliding fit around the valve stem 204. Lower seal 230 is mounted in a lower annular recess within the housing 207 and in the "rest" condition the resilient lower seal 230 is bent upwards by contact with the biased valve stem, so as partly to expose the radially outer ends of first apertures 256. However, it will be appreciated that the bending upwards of the lower seal 230 is not an essential feature of the invention. Upper seal 229 is mounted in an annular recess at the upper end of the housing 207 and is adapted to close third apertures 228 in the rest condition (illustrated in FIG. 2A).

Operation of the illustrated device is as follows.

In the "rest" condition illustrated in FIG. 2A, the piston 231 is at its lower limit position and the metering valve assembly 203 is filled with liquid up to the level of seal 229. Once valve stem 204 is depressed, the third apertures 228 move away from the upper seal 229 so as to open to fluid flow, and the first apertures 256 move toward the lower seal 230 which relaxes from its bent configuration (shown in FIG. 2A) to close first apertures 256 to fluid flow. The piston 231 is forced upwardly by liquid pressure so that it moves from its lower limit position, past the intermediate position illustrated in FIG. 2B, to its upper limit position and, in doing so, causes the metered volume of liquid 234*b* to be dispensed through apertures 228. Once the valve stem is released and it returns to its uppermost position under the action of spring 222, the third apertures 228 again become closed to liquid flow by the seal 229, but liquid is now able to flow past the lower seal 230, which has returned to its bent configuration, and enter the lower chamber 234*a* through the second apertures 226 above the level of the piston 231, which now moves downwardly to its lower limit position so that the metered volume 234*b* is recharged.

Figure 2B:
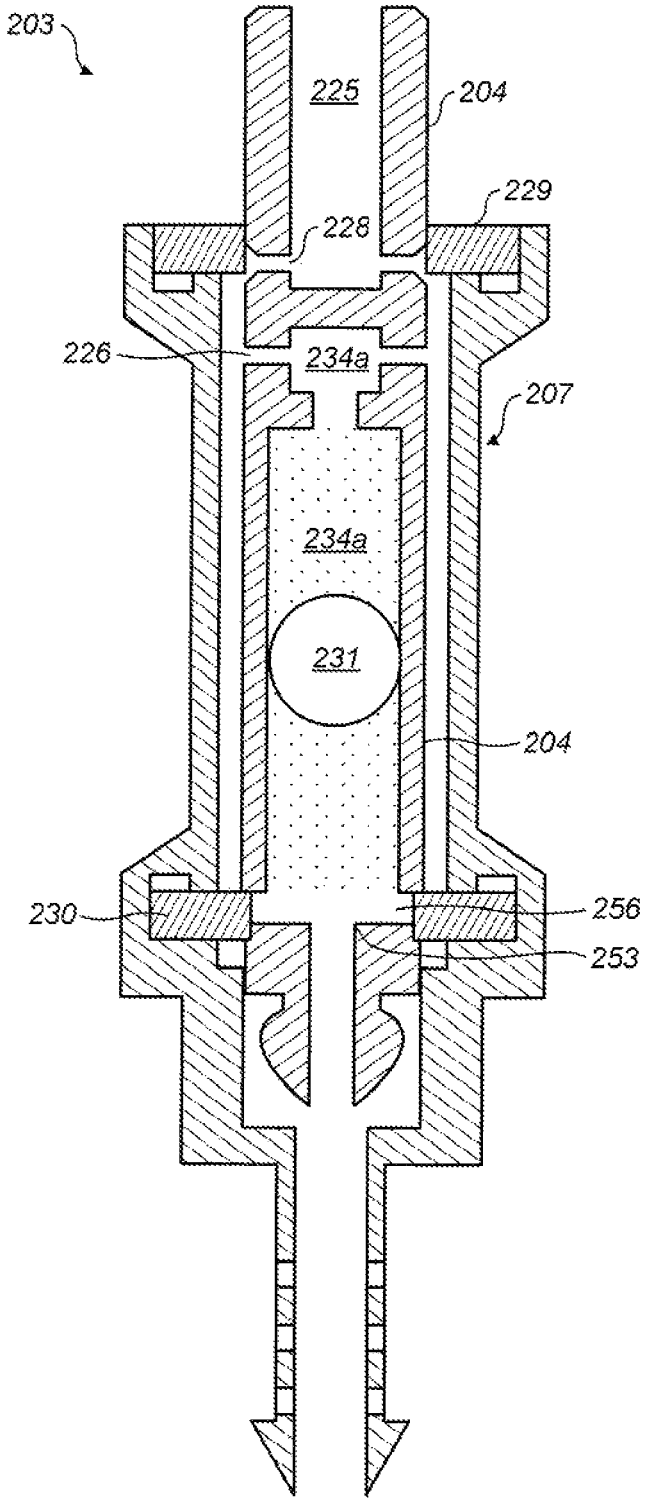

It will be appreciated that the embodiment of FIGS. 2A and 2B is somewhat simpler than that shown for FIG. 1, this simplification being achieved by providing a valve stem 204 without a flange 120, with upper and lower seals 229 and 230 mounted within the housing 207, simplifying assembly. Upper and lower seals 229 and 230 can be of identical design, reducing the component inventory required in manufacture.

Figure 3A:
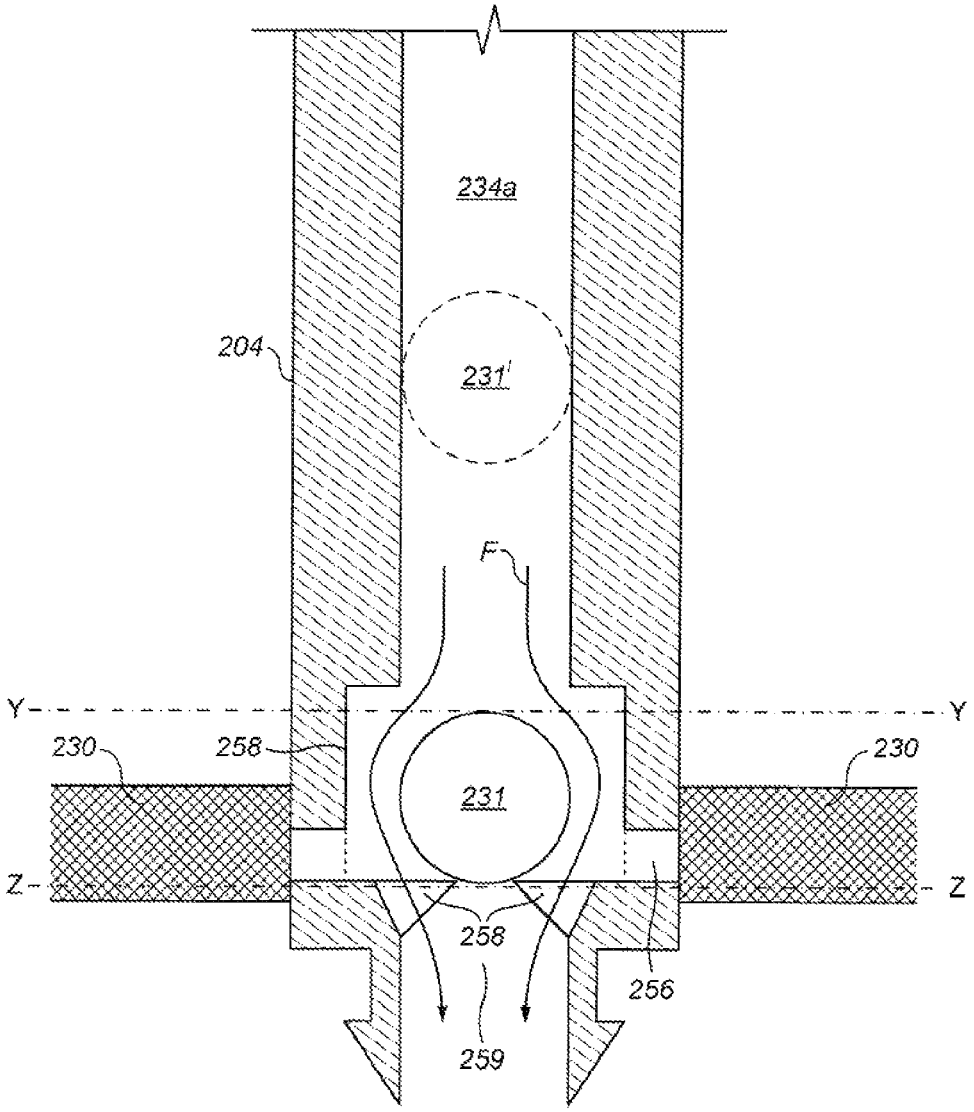
FIGS. 3A, 3B and 3C illustrate sectional views of an apparatus in accordance with a further embodiment of the invention.
Figure 3B:
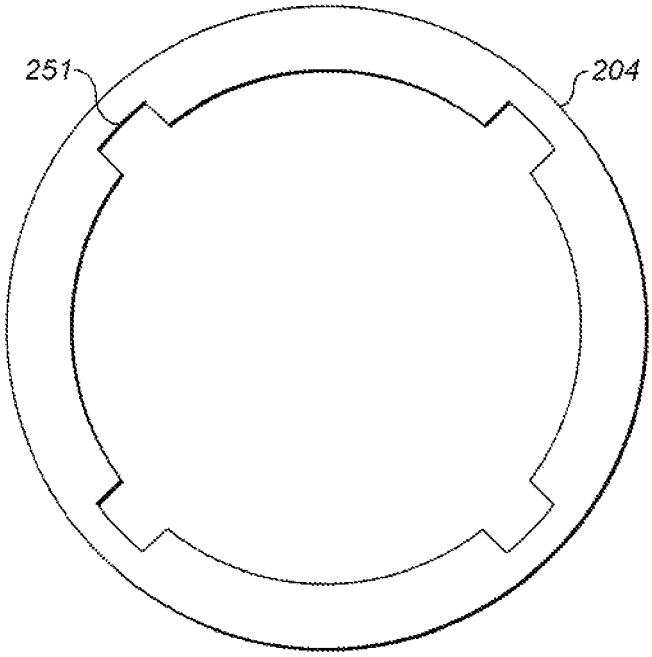
Figure 3C:
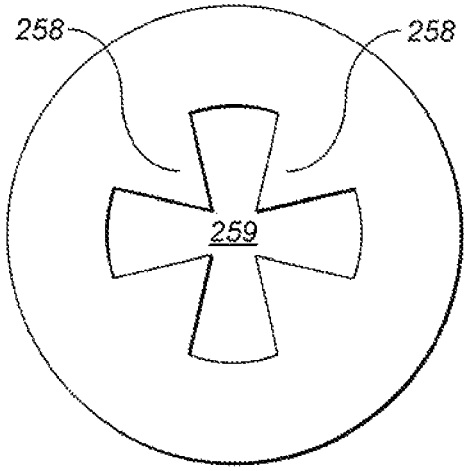

A modification of the embodiment shown in FIG. 2A is shown in FIGS. 3A, 3B and 3C. FIG. 3A illustrates the lower part of a valve stem 204. FIGS. 3B and 3C are respectively sections of the valve stem 204 on the lines Y-Y and Z-Z in FIG. 3A. In the embodiment of FIG. 3A, the inner surface of the cylindrical lower chamber 234*a* is formed with a number of channels 251, which (as further illustrated in FIG. 3B) extend axially from a position above the level of seat 253 to a position above the piston 231. In the embodiment of FIG. 3 the seat 253 is formed of four angularly spaced ribs 258 which together define a central aperture 259. At "rest", in the lower limit position, the piston 231 rests on the ribs 258. In contrast, in the "discharge" condition, the piston 231 moves up within the lower chamber 234*a* as the metered volume is discharged, and FIG. 3A shows the piston at an intermediary position 231' above the channels 251 and in close contact with the interior surface of the metering chamber 234*a*.

This construction is intended to enable filling or re-filling of the container through the liquid conduit when the valve stem 204 is depressed and a pressurised reservoir of liquid and/or gas is coupled to the upper chamber. Subject to the reservoir pressure exceeding the pressure within the container, the piston 231 is maintained in the "rest" position (lower limit position), resting on the ribs 258. Accordingly injected fluid from the reservoir flows, in the direction of arrows F, through the third apertures 228, into metering chamber 234*a*, around the piston 231, through the central aperture 259 and down the inlet 211 into the container. Accordingly fluid (liquid and/or gas) is able to flow downwardly past the piston 231 when it is in its lower limit position, but is not able to flow past the piston 231 when it is in a raised position above the level of the channels 251.

Figure 4:
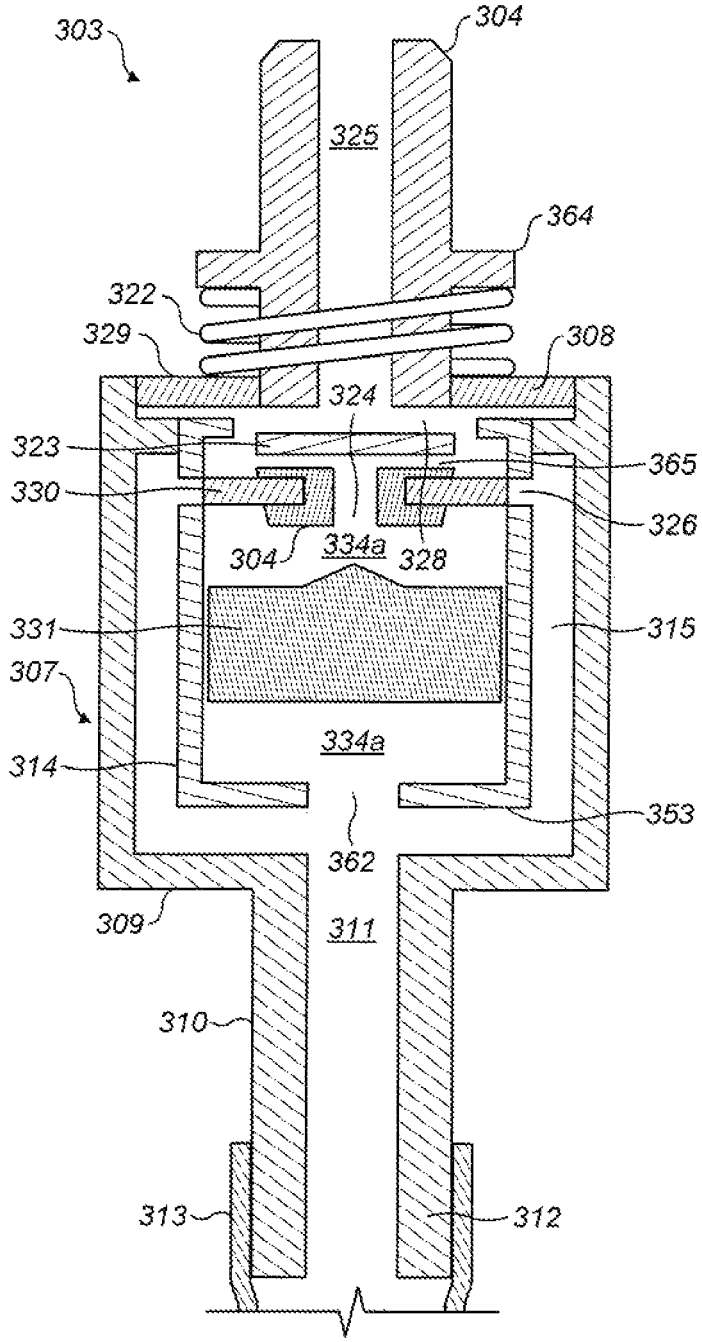
FIG. 4 is an axial section of a further embodiment of liquid dispensing apparatus in accordance with the invention.

FIG. 4 illustrates a further embodiment of the metering valve assembly 303 for use in dispensing apparatus according to the invention. The metering chamber 334*a* and piston 331 for dispensing the metered volume 334*b* (not labelled) of liquid is provided internally of the valve stem 304. FIG. 4 shows the metering valve assembly 303 with the valve stem 304 in the depressed, lowermost position, with the piston 331 in an intermediary position, in which the metering volume 334*b* is partially discharged.

The metering valve assembly 303 comprises a housing 307 that locates within a container (not shown) and is generally cylindrical. Lower wall 309 of housing 307 is provided with a depending spigot 310 defining an inlet 311 for housing 307 and having a lower end 312 on which is located the upper end of a dip tube 313 that extends to a lower region of the container.

Provided within the housing 307 is a generally tubular partition wall 314 which defines an annular space 315 between its outer surface and the inner surface of the cylindrical wall of the housing 307. Upper apertures 326 are formed in the partition wall 314, and central lower aperture 362 is formed centrally in the lower end wall of the 353.

Valve stem 304 (as seen in FIG. 4, in the depressed, lowermost position) is of a length such that its upper end projects out of the housing 307. The valve stem 304 is provided with a flange 364 and a spring 322 is located around the valve stem between the flange 364 and the upper wall 308 of the housing 307. The spring 322 serves to bias valve stem 304 upwardly to its first limit position.

Valve stem 304 is generally tubular along its length but is sub-divided by a partition wall 323 into upper (open-topped) chamber 325 and (open-bottomed) central aperture 324. The upper chamber 325 is part of the discharge conduit arrangement of the valve stem 304.

Provided within metering chamber 334*a* is generally cylindrical piston 331, which is negatively buoyant relative to liquid held within the connected container for discharge by the metering valve assembly. Piston 331 is capable of travel between a lower limit position, limited by lower end wall 353 provided at a lower end of the metering chamber 334*a*, and an upper limit position defined by the lower extension of the valve stem 304, such that the piston 331 seals the lower aperture 362. Accordingly the piston 331 moves within the metering chamber 334*a* during operation, sweeping out a metered volume 334*b*.

Lower region of upper chamber 325 is provided with apertures 328, and central aperture 324 connects with radial apertures 365 extending radially outward through the wall of valve stem 304.

Upper and lower seals 329 and 330 are provided within the metering valve assembly 303. Upper seal 329 is mounted in an annular recess at the upper end of the housing 307, forms a sliding fit around the valve stem 304, and is adapted to close apertures 328. Lower seal 330 is mounted in a recess around the lower end of the valve stem 304, forms a sliding fit with the interior surface of partition wall 314, and is adapted to close apertures 326.

In the "rest" condition apertures 326 are open and apertures 328 are closed, and vice versa when the metering valve assembly 303 is in the discharge condition with the valve stem 304 depressed (as shown in FIG. 4).

Operation of the illustrated device is as follows.

In the "rest" condition the piston 331 is at its lower limit position and the metering valve assembly 303 is filled with liquid up to the level of seal 329. Once valve stem 304 is depressed, the apertures 328 move away from the upper seal 329, to the position shown in FIG. 4, and open apertures 328 to fluid flow, and the apertures 326 move toward the lower seal 330 and close to fluid flow. Thus liquid flow through the apertures 328 is enabled. The piston 331 is forced upwardly by liquid pressure from the container so that it moves from its lowermost limit position against the lower end wall 353 to its upper limit position against the lower end of stem 304, and in doing so discharges the metered volume of liquid 234*b*, with a corresponding flow of liquid from the container through lower aperture 362 and into the metering chamber 334*a* beneath the piston 331. FIG. 4 illustrates the metering valve assembly 303 when the valve stem 204 is in the depressed, lowermost position and the metered volume 234*b* is partially dispensed. Once the valve stem is released and it returns to its uppermost position under the action of spring 322, the apertures 328 again become closed to liquid flow, and apertures 326 become open, such that liquid is now able to flow into the metering chamber 234*a* through the apertures 326 above the level of the piston 331, which now moves downwardly to its lower limit position so that the metered volume 334*b* is recharged.

This assembly embodiment of the invention provides a metering valve that is suitable for delivering spray bursts having relatively large metered volumes (for example 300 $mm^3$ and greater).

It should be appreciated that shapes of pistons other than those illustrated may be used in the embodiments of FIGS. 1 and 4, for example, spherical shapes will also operate satisfactorily. Similarly, it should be appreciated that shapes of pistons other than those illustrated may be used in the embodiments of FIGS. 2 and 3, for example, generally cylindrical shapes will also operate satisfactorily.

It should be appreciated that other than substantially insoluble compressed gas propellants, liquefied gas propellants may be used in the embodiments of the invention.

The apparatus of the present invention may be used to as aerosol spraying device. Such a device may be used to deliver various materials, preferably materials dissolved or dispersed in water. For example, the liquid in the container may contain a range of materials selected from the group consisting of pharmaceutical, agrochemical, fragrance, air freshener, odour neutraliser, sanitizing agent, polish, insecticide depilatory chemical (such as calcium thioglycolate), epilatory chemical, cosmetic agent, deodorant, anti-perspirant, antibacterial agents, anti-allergenic compounds, and mixtures of two or more thereof. Furthermore, the container may contain a foamable composition, optionally containing any of the materials disclosed immediately hereinbefore. The water in the container may optionally contain one or more organic solvents or dispersants in order to aid dissolution or dispersion of the materials in the water.

The apparatus of the present invention may be used with an apparatus having a dispensing mechanism which turns on and off periodically. This may be automated.

For example, the apparatus of the present invention may be used to provide an air treatment agent to an air treatment device comprising: an airborne agent detector comprising one or more airborne agent sensors, wherein the airborne agent detector comprises means to detect a threshold level or concentration of an airborne agent; a means to mount the apparatus of the present invention (including the pressurised container where present) to the device; and a means to expel a portion of air treatment agent from the apparatus of the present invention, upon detection of an airborne agent by the detector. Such an air treatment device (not including the apparatus of the present invention) is disclosed in WO 2005/

018690 for example. Alternatively, the apparatus of the present invention may be used to dispense a composition from a spraying device as disclosed in WO 2007/045826.

The invention claimed is:

1. A discharge assembly apparatus for discharging a metered volume of a liquid when used in combination with a liquid-containing, pressurised or pressurisable container, wherein the discharge assembly apparatus has:

(a) an actuator assembly incorporating a valve stem adapted for movement from a first limit position to a second limit position, said valve stem having a discharge conduit arrangement with an inlet through which liquid is introduced into the discharge conduit arrangement and an outlet from which liquid is discharged from the apparatus;

(b) a metering chamber formed within the valve stem and incorporating (i) a liquid discharge element which is moveable by fluid pressure from the container from a liquid primed position to a liquid discharged position to effect discharge of said metered volume of liquid and is moveable by a returning force from its liquid discharged position to its liquid primed position; and (ii) an inlet/outlet arrangement for introduction of liquid from the container into the metering chamber and for discharge of liquid from the metering chamber; and (c) a housing wherein:

(iii) the valve stem and the inner surface of the housing are arranged such that a fluid transfer passageway is defined therebetween, and (iv) the discharge conduit arrangement of the valve stem provides in the second limit position thereof communication between the outlet of the metering chamber and the outlet of the valve stem via said fluid transfer passageway;

wherein the liquid discharge element is substantially spherical;

wherein the liquid discharge element is free from physical contact with a return spring.

2. A liquid dispensing apparatus having a discharge assembly according to claim 1, further comprising a pressurised or pressurisable container, said apparatus being used for discharging a metered volume of a liquid held in the container.

3. Apparatus according to claim 2 wherein the container is pressurised with nitrogen, air, liquefied natural gas, liquefied hydrocarbon gas or carbon dioxide.

4. Apparatus according to claim 2 which is an aerosol spraying device.

5. A liquid dispensing apparatus according to claim 2 which contains a material selected from the group consisting of pharmaceutical, agrochemical, fragrance, air freshener, odour neutraliser, sanitizing agent, polish, insecticide, depilatory chemical (such as calcium thioglycolate), epilatory chemical, cosmetic agent, deodorant, anti-perspirant, anti-bacterial agents, anti-allergenic compounds, and mixtures of two or more thereof.

6. Apparatus according to claim 2 which contains a foamable composition.

7. Apparatus according to claim 1 wherein the discharge conduit arrangement of the valve stem includes a discharge passageway having a liquid inlet which is closed to discharge flow in the first limit position of the valve stem and in communication with said fluid transfer passageway in the second limit position of the actuator to provide for discharge of liquid from the metering chamber.

8. Apparatus according to claim 7 wherein the metering chamber has a port located within said fluid transfer passageway, said port serving as an inlet to the metering chamber and an outlet thereof.

9. Apparatus according to claim wherein a fluid transfer arrangement, preferably an annular space, is provided between the outer surface of the valve stem and the inner surface of the housing of the discharge assembly, for providing communication between the pressurised container and inlet of the metering chamber and wherein, in the first limit position of the valve stem the valving arrangement allows said fluid transfer arrangement to fluid flow from the pressurised container to the inlet of the metering chamber.

10. Apparatus according to claim 9 wherein the valving arrangement comprises first and second axially spaced seals, the second seal being located around the valve stem, and the valving arrangement is such that in the first limit position of the valve stem the first seal closes the liquid inlet to the liquid discharge passageway of the valve stem or otherwise prevents discharge of liquid from the liquid discharge passageway, and the second seal allows liquid to pass from the container to the liquid inlet of the metering chamber whereas in the second limit position of the valve stem the second seal prevents passage of liquid from the container to the metering chamber and the liquid inlet to the discharge passageway is open.

11. Apparatus according to claim 9 wherein the liquid discharge element has:

a) a first side exposed to said metering chamber and an opposite second side exposed to fluid pressure from the container, the metering chamber is provided on the first side of the liquid discharge element with an inlet/outlet arrangement for introduction of liquid from the container into the metering chamber and for discharge of liquid from the metering chamber, (b) a lower inlet in the valve stem providing fluid communication between the container and the second side of the liquid discharge element, (c) a lower aperture in the wall of the valve stem provides fluid communication between the second side of the discharge element and the annular space, and (d) the inlet/outlet arrangement is provided in the metering chamber on the first side of the liquid discharge element.

12. Apparatus according to claim 1 wherein the valve stem is biased from the second limit position to the first limit position.

13. Apparatus according to claim 1 wherein the liquid discharge element is moved from the liquid primed position to the liquid discharged position against the returning force.

14. Apparatus according to claim 1 wherein the liquid discharge element is negatively buoyant in the liquid to be dispensed so as to provide at least a part of said returning force.

15. Apparatus according to claim 1 which comprises:

(a) a valving arrangement such that when the valve stem is in its first limit position liquid may flow into the metering chamber from the pressurised container through the inlet/outlet arrangement and may not flow out of the metering chamber through the inlet/outlet arrangement and vice versa when the valve stem is at its second limit position.

16. Apparatus according to claim 15, wherein the valving arrangement comprises first and second axially spaced seals arranged such that, in the first limit position of the valve stem, the first seal closes the liquid inlet to a discharge passageway of the valve stem and the inlet, to the metering chamber is open whereas in the second limit position of the valve stem the second seal closes, said inlet to the metering chamber and the liquid inlet to the discharge passageway is open.

17. Apparatus according to claim 1 which comprises:

(a) a valving arrangement such that when the valve stem is in its first limit position liquid may not flow out of the metering chamber through the inlet/outlet arrangement into the discharge conduit and when the valve stem is in its second limit position liquid may flow out of the metering chamber through the inlet/outlet arrangement into the discharge conduit.

18. Apparatus according to claim 1 wherein the liquid discharge element is moveable along an interior surface of the valve stem.

* * * * *

UNITED STATES PATENT AND TRADEMARK OFFICE

CERTIFICATE OF CORRECTION

PATENT NO. : 8,820,588 B2
APPLICATION NO. : 12/901043
DATED : September 2, 2014
INVENTOR(S) : Ghasem Ghavami-Nasr et al.

It is certified that error appears in the above-identified patent and that said Letters Patent is hereby corrected as shown below:

In the Claims

Column 12, Line 5, insert --1-- after claim

Signed and Sealed this
First Day of September, 2015

Michelle K. Lee

Michelle K. Lee
*Director of the United States Patent and Trademark Office*